US011075475B2

(12) United States Patent
Chen

(10) Patent No.: US 11,075,475 B2
(45) Date of Patent: Jul. 27, 2021

(54) ELECTRICAL CONNECTOR ASSEMBLY

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventor: Ming-Ching Chen, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/853,633

(22) Filed: Apr. 20, 2020

(65) Prior Publication Data

US 2020/0335893 A1 Oct. 22, 2020

(30) Foreign Application Priority Data

Apr. 18, 2019 (CN) ..... 201920533166.8

(51) Int. Cl.
*H01R 12/00* (2006.01)
*H01R 12/71* (2011.01)
(Continued)

(52) U.S. Cl.
CPC ..... *H01R 12/716* (2013.01); *H01R 13/50* (2013.01); *H01R 13/6273* (2013.01); *H01R 13/6585* (2013.01)

(58) Field of Classification Search
CPC .. H01R 12/716; H01R 13/6273; H01R 13/50; H01R 13/6585; H01R 13/20; H01R 13/405; H01R 12/73
(Continued)

(56) References Cited

U.S. PATENT DOCUMENTS 6,503,101 B1 * 1/2003 Yu ..... H01R 13/6597 439/607.36
8,888,506 B2 * 11/2014 Nishimura ..... H01R 43/24 439/74
(Continued)

FOREIGN PATENT DOCUMENTS

CN 201072831 Y 6/2008
CN 108390213 A 8/2018

*Primary Examiner* — Abdullah A Riyami
*Assistant Examiner* — Nelson R. Burgos-Guntin
(74) *Attorney, Agent, or Firm* — Ming Chieh Chang; Wei Te Chung

(57) ABSTRACT

A receptacle connector includes an insulative receptacle housing, two rows of receptacle contacts retained to the receptacle housing, a one-piece metallic shell member retained to the receptacle housing and having a circumferential structure continuously surrounding the receptacle housing wherein a shielding/grounding member unitarily extends from the shell member and into an center island of the receptacle housing to separate the two rows of contacts in the transverse direction. A plug connector includes an insulative plug housing, two rows of plug contacts, and a pair of grounding blocks at two ends. During mating, two opposite ends of the shielding/grounding member mechanically and electrically connect to the pair of metallic grounding blocks or locking members, respectively.

20 Claims, 12 Drawing Sheets

(51) Int. Cl.
*H01R 13/627* (2006.01)
*H01R 13/50* (2006.01)
*H01R 13/6585* (2011.01)

(58) Field of Classification Search
USPC ..... 439/345
See application file for complete search history.

(56) References Cited

U.S. PATENT DOCUMENTS 8,986,027 B2 * 3/2015 Nishimura ..... H01R 12/707 439/181
10,446,985 B2 10/2019 Hirose
2005/0032400 A1 * 2/2005 Zhang ..... H01R 12/716 439/74
2005/0042924 A1 * 2/2005 Zhang ..... H01R 13/6582 439/607.36
2006/0063432 A1 * 3/2006 Chen ..... H01R 13/658 439/607.36
2006/0276061 A1 * 12/2006 Koguchi ..... H01R 12/725 439/74
2008/0207014 A1 * 8/2008 Takeuchi ..... H01R 12/716 439/74
2008/0305657 A1 * 12/2008 Midorikawa ..... H01R 43/0235 439/74
2009/0061655 A1 * 3/2009 Miyazaki ..... H01R 12/57 439/74
2010/0068900 A1 * 3/2010 Wu ..... H01R 12/716 439/74
2011/0263140 A1 * 10/2011 Sato ..... H01R 12/7052 439/74
2013/0012039 A1 * 1/2013 Nose ..... H01R 12/716 439/74
2015/0079816 A1 * 3/2015 Suzuki ..... H01R 12/7082 439/74
2015/0140840 A1 * 5/2015 Nishimura ..... H01R 13/6594 439/74
2015/0140841 A1 * 5/2015 Watanabe ..... H01R 43/18 439/74
2015/0207248 A1 * 7/2015 Takenaga ..... H01R 13/6582 439/74
2016/0036145 A1 * 2/2016 Hasegawa ..... H01R 12/716 439/78
2016/0190719 A1 * 6/2016 Brzezinski ..... H01R 12/73 439/74
2017/0033505 A1 * 2/2017 Ozeki ..... H01R 12/716
2018/0175561 A1 * 6/2018 Chen ..... H01R 12/52
2020/0044374 A1 * 2/2020 Ishida ..... H01R 12/721
2020/0212635 A1 * 7/2020 Chen ..... H01R 13/6471
2020/0335893 A1 * 10/2020 Chen ..... H01R 12/716

* cited by examiner

ELECTRICAL CONNECTOR ASSEMBLY

BACKGROUND OF THE INVENTION

1. Field of the Invention

The present invention relates to an electrical connector assembly, especially to the electrical connector assembly with grounding and shielding between two rows of contacts.

2. Description of Related Arts

U.S. Pat. No. 10,396,479 discloses an electrical (board-to-board) connector assembly with the mated plug connector and receptacle connector with the shielding/grounding members at the centerline between two rows of contacts. Notably, the shielding/grounding member is essentially discrete from either the contacts or the shell of the connector, thus resulting in an odd arrangement. U.S. Pat. No. 10,446,985 discloses the similar electrical (board-to-board) connector assembly with the mated plug connector and receptacle connector with the shielding/grounding member at the centerline. Anyhow, such a shielding/grounding member unitarily extends from a grounding contact located around an end of the side wall or a locking part located at the end wall, thus also resulting in another odd arrangement thereof.

Therefore, it is desired to provide an electrical (board-to-board) connector assembly with the mated receptacle connector and plug connector wherein the corresponding shielding/grounding member is robustly arranged in a rigid manner.

SUMMARY OF THE INVENTION

To achieve the above desire, an electrical board-to-board connector assembly includes a receptacle connector mounted upon a first printed circuit board (not shown) and a plug connector mounted upon a second printed circuit board for mating with each other. The receptacle connector includes an insulative receptacle housing, two rows of receptacle contacts retained to the receptacle housing, a one-piece metallic shell member retained to the receptacle housing and having a circumferential structure continuously surrounding the receptacle housing wherein a shielding/grounding member unitarily extends from the shell member and into an center island of the receptacle housing to separate the two rows of contacts in the transverse direction. The plug connector includes an insulative plug housing, two rows of plug contacts, and a pair of grounding blocks at two ends. During mating, two opposite ends of the shielding/grounding member mechanically and electrically connect to the pair of metallic grounding blocks or locking members, respectively.

DETAILED DESCRIPTION OF THE PREFERRED EMBODIMENT

Figure 1:
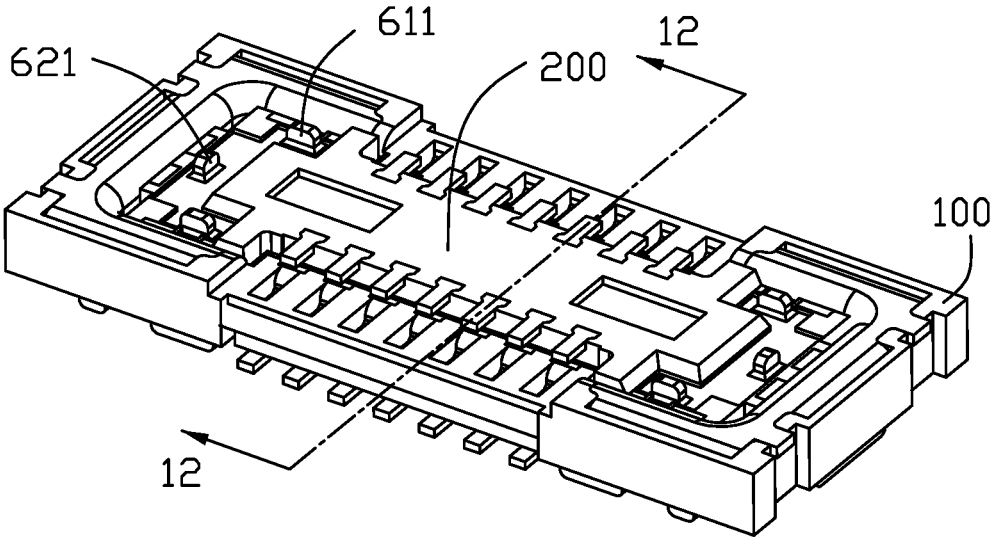
FIG. 1 is a perspective view of an electrical connector assembly of an embodiment of this present invention.
Figure 2:
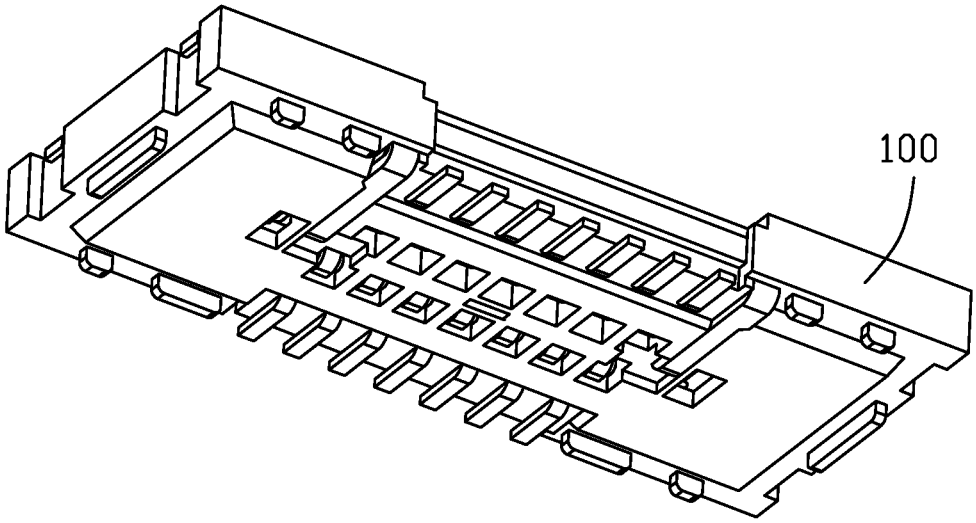
FIG. 2 is another perspective view of the electrical connector assembly of FIG. 1.
Figure 3:
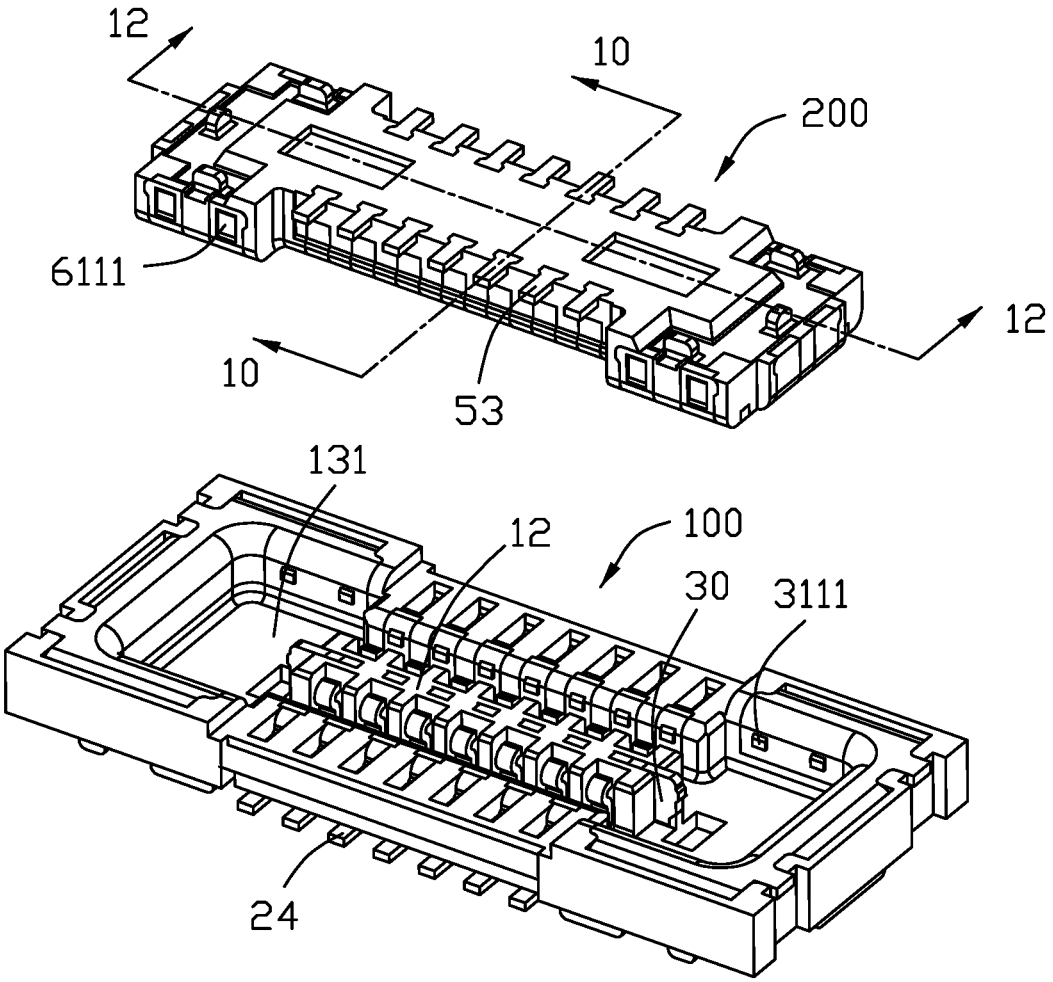
FIG. 3 is an exploded perspective view of the electrical connector assembly of FIG. 1 wherein the receptacle connector and the plug connector are separated from each other.
Figure 4:
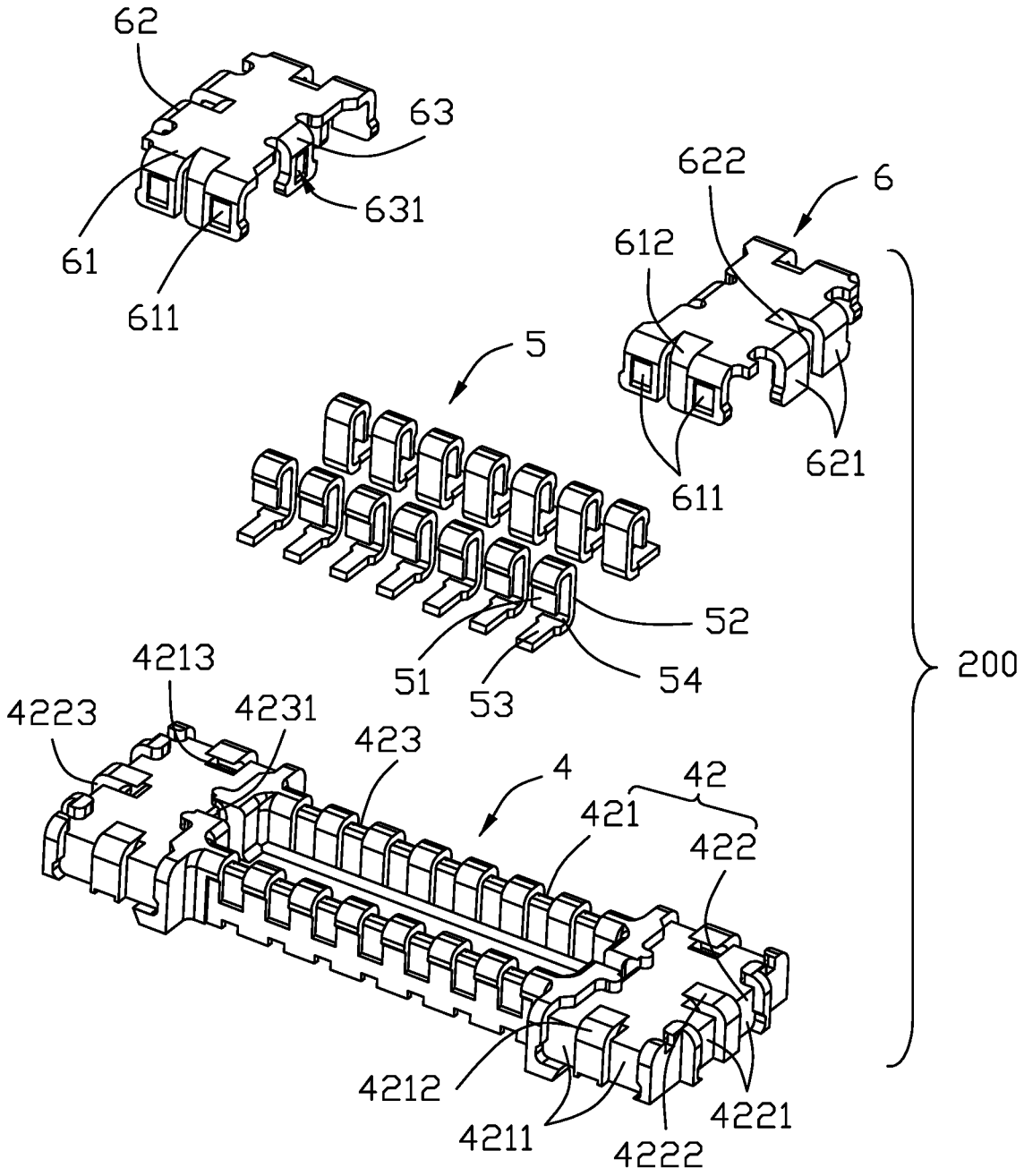
FIG. 4 is an exploded perspective view of the plug connector of the electrical connector assembly of FIG. 1.
Figure 5:
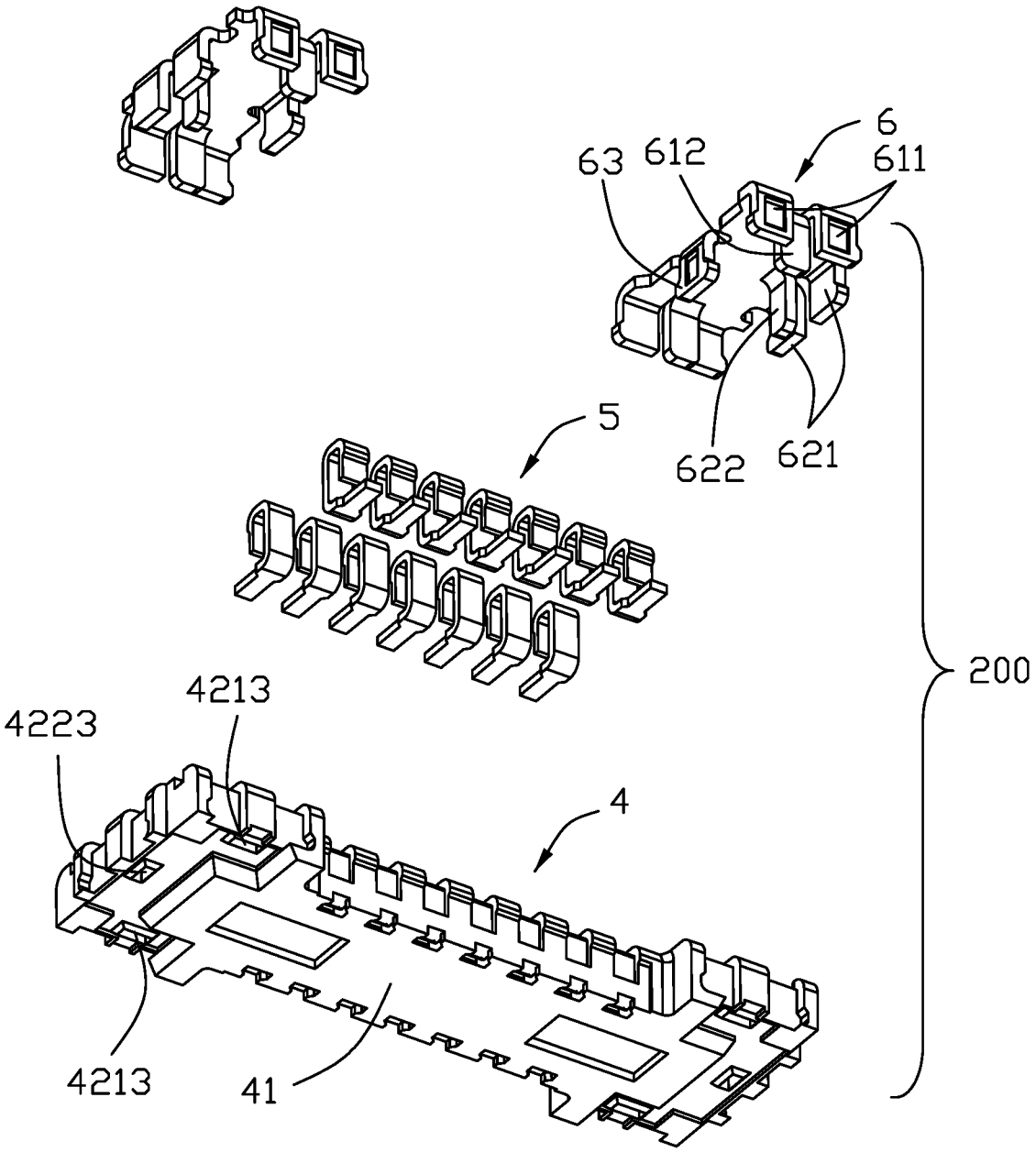
FIG. 5 is another exploded perspective view of the plug connector of the electrical connector assembly of FIG. 4.
Figure 6:
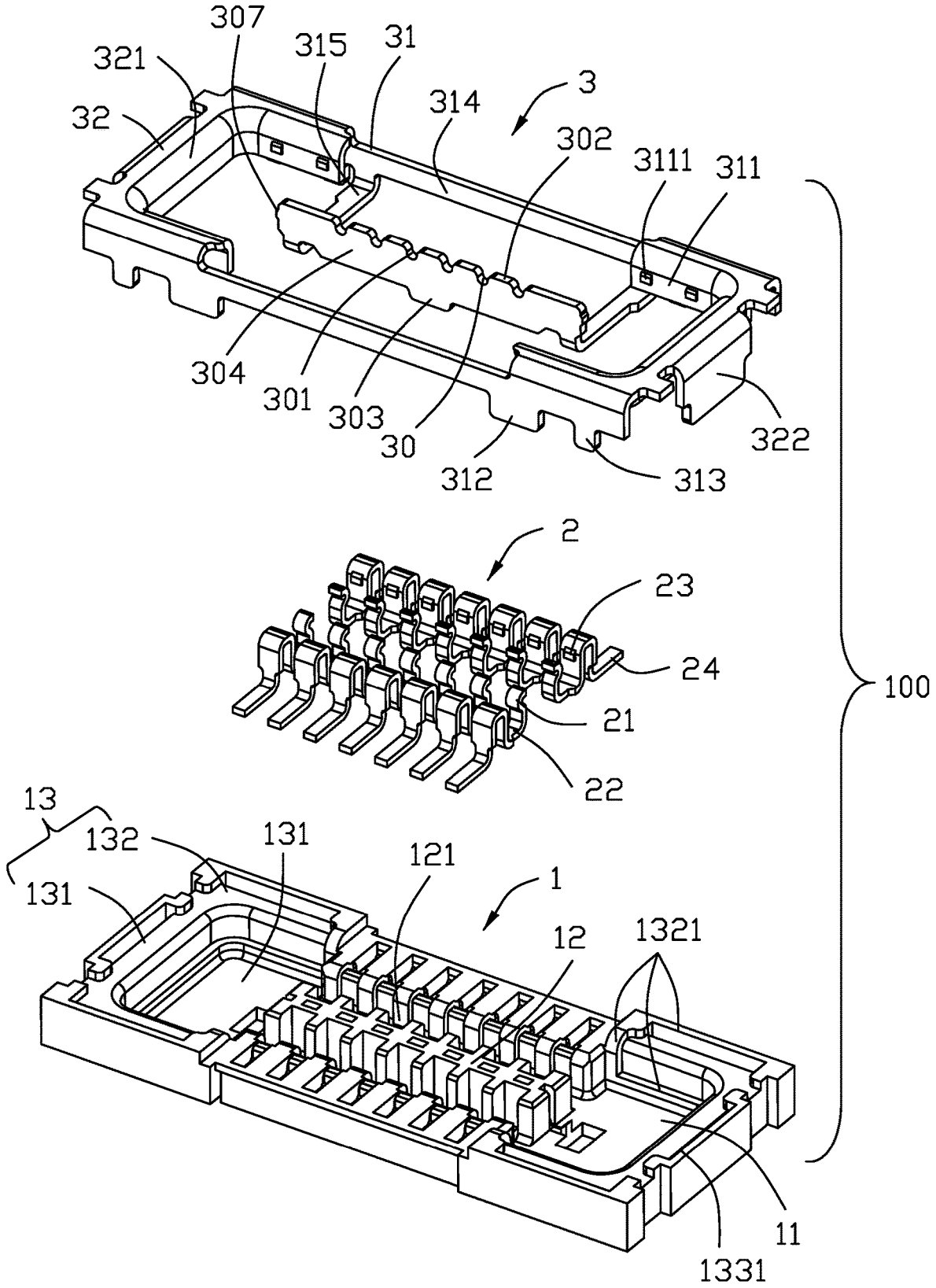
FIG. 6 is an exploded perspective view of the receptacle connector of the electrical connector assembly of FIG. 1.
Figure 7:
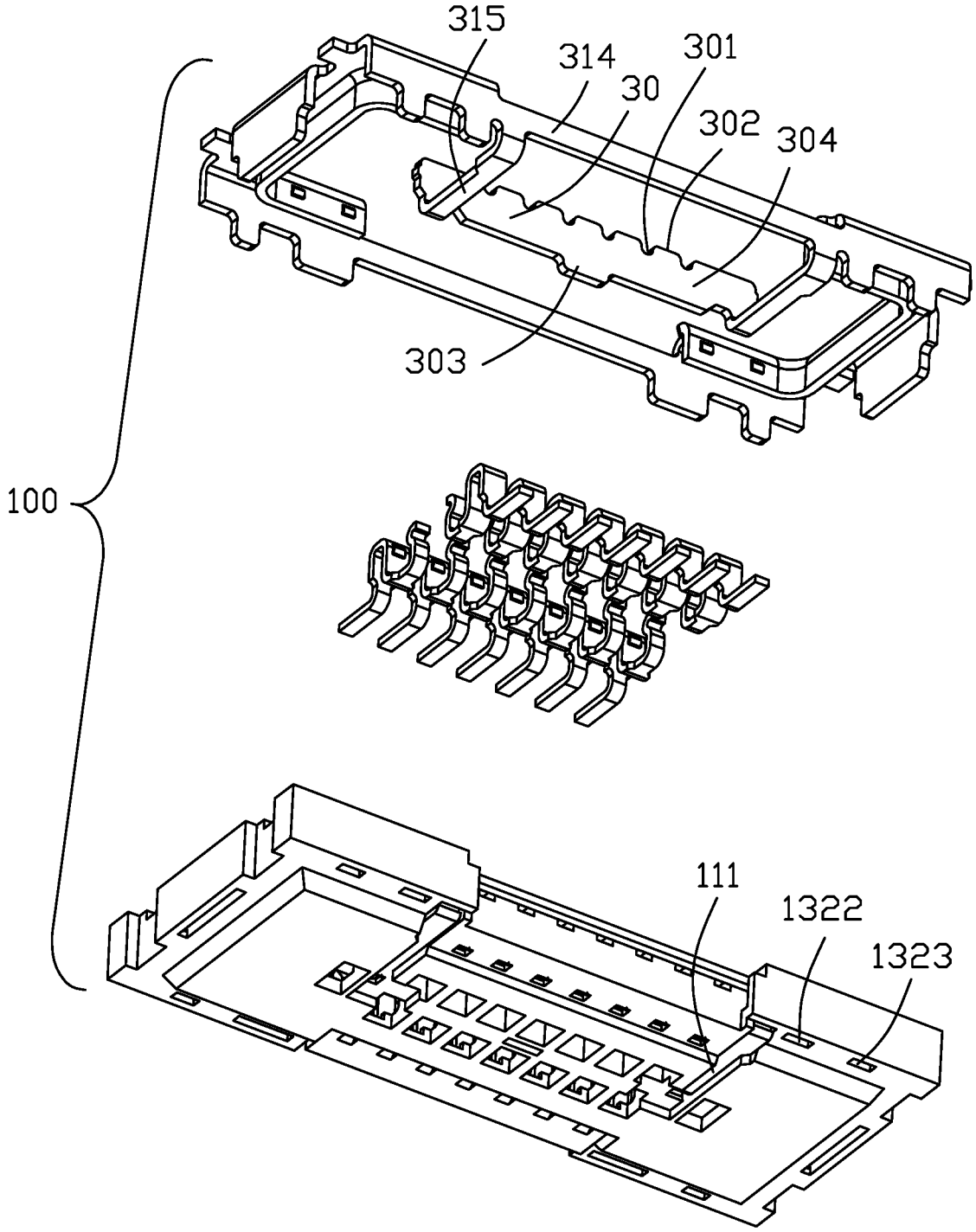
FIG. 7 is another exploded perspective view of the receptacle connector of the electrical connector assembly of FIG. 6.
Figure 8:
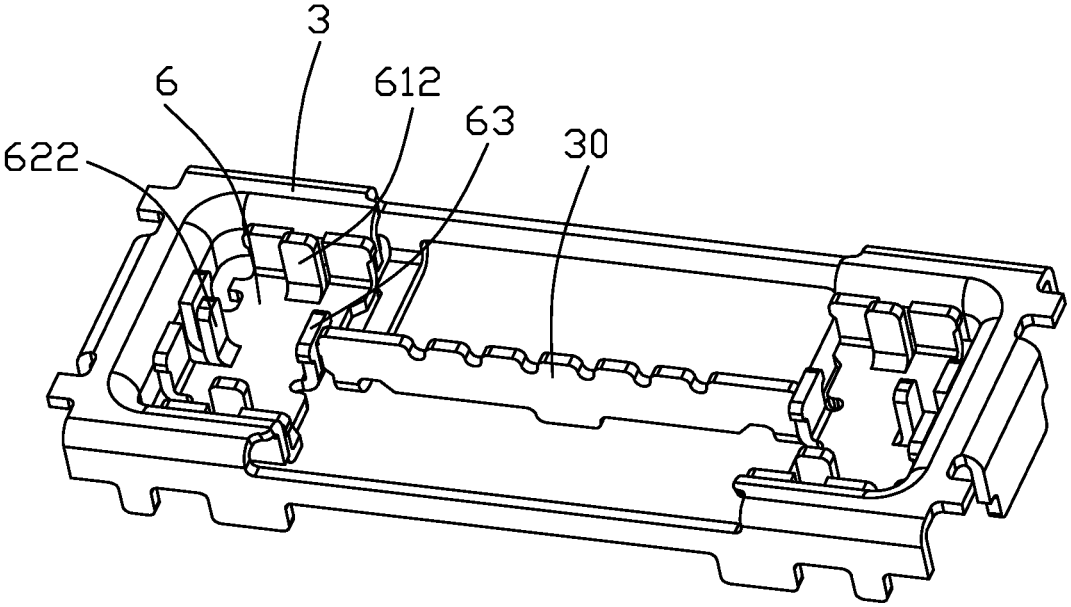
FIG. 8 is a perspective view of the shell member of the receptacle connector of the electrical connector assembly of FIG. 6.
Figure 9:
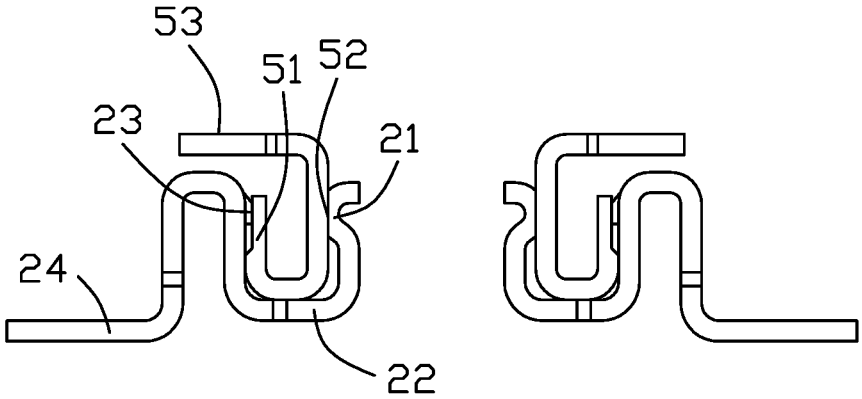
FIG. 9 is a side view showing the receptacle contacts and the plug contacts mated with each other of the electrical connector assembly of FIG. 1.
Figure 10:
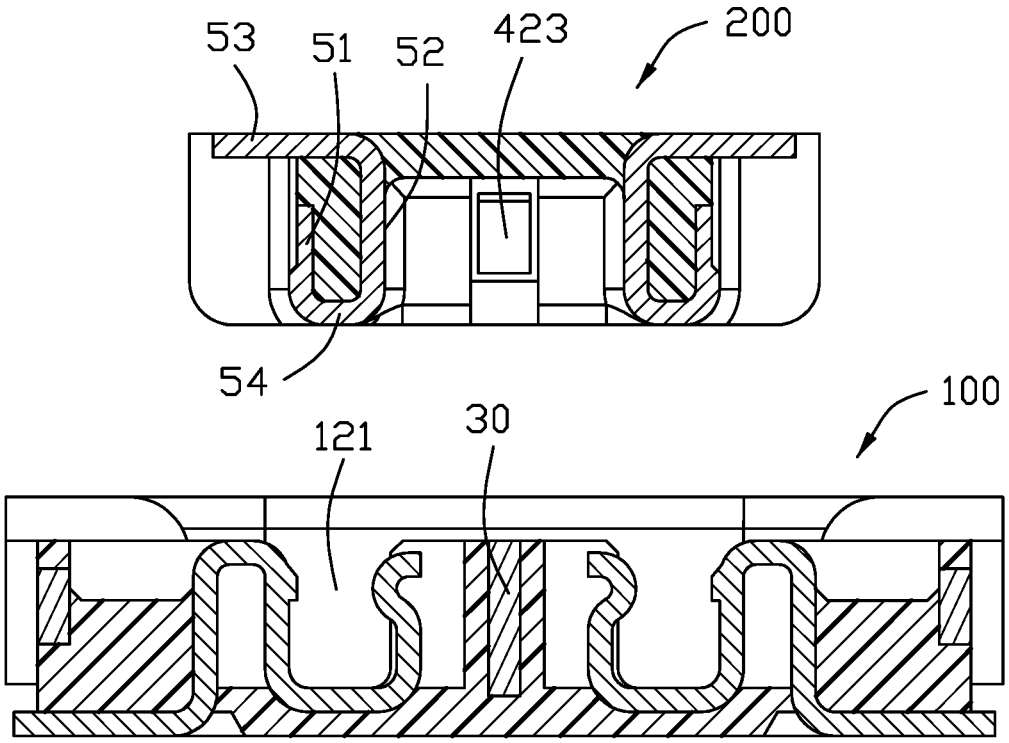
FIG. 10 is a cross-sectional view of the electrical connector assembly of FIG. 3 along line 10-10.
Figure 11:
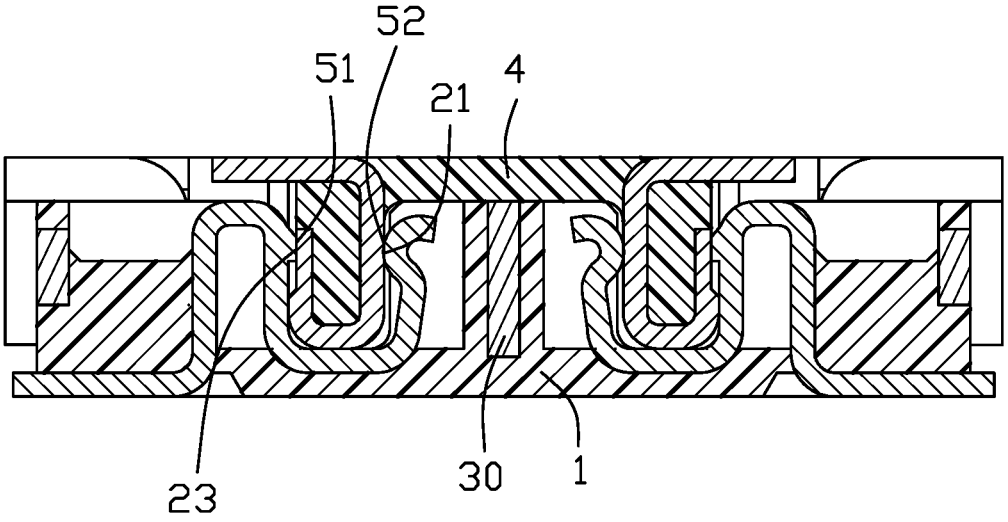
FIG. 11 is a cross-sectional view of the electrical connector assembly of FIG. 1 along line 11-11.
Figure 12:
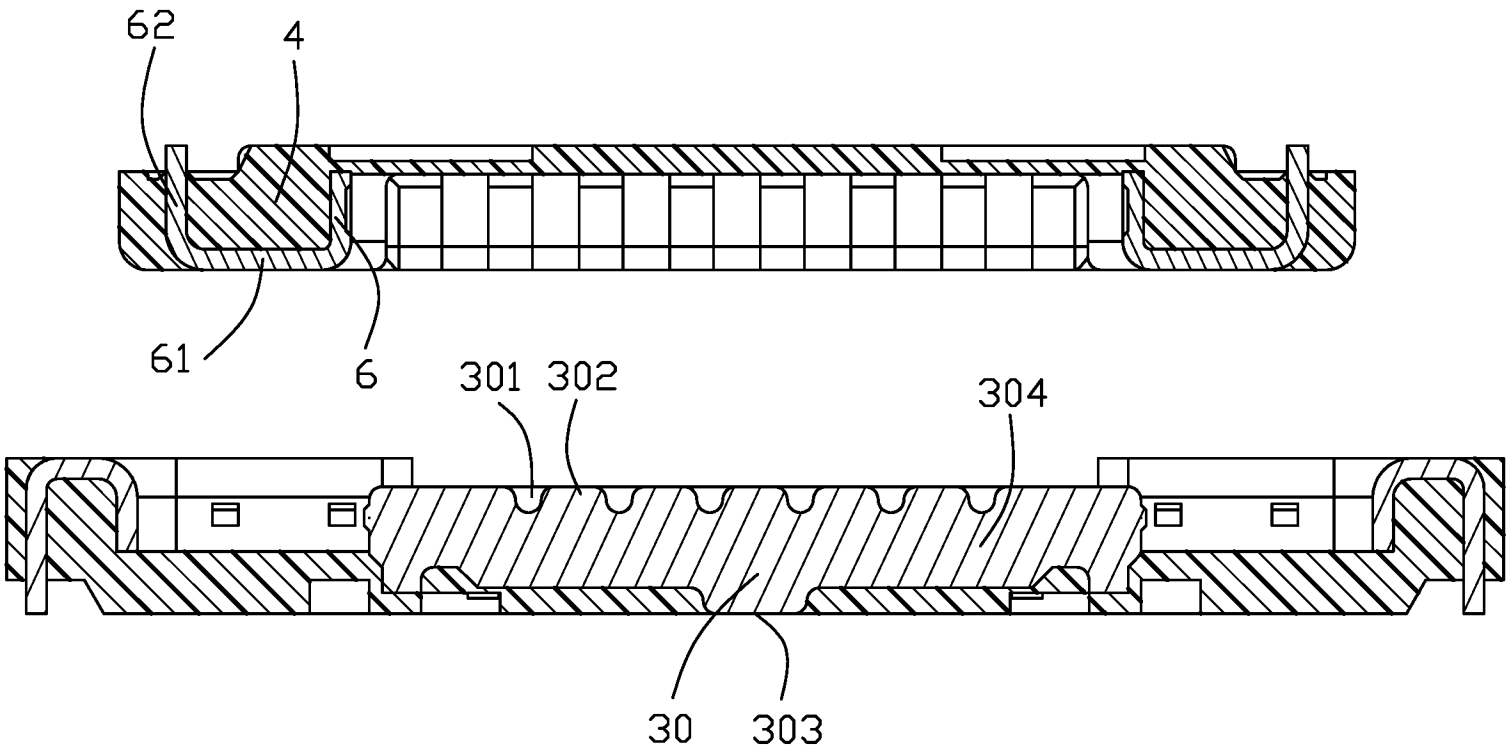
FIG. 12 is a cross-sectional view of the electrical connector assembly of FIG. 3 along line 12-12.

Referring to FIGS. 1-12, an electrical connector assembly includes a receptacle connector 100 for mounting to a printed circuit board (not shown), and a plug connector 200 for mounting to another printed circuit board (not shown) wherein the receptacle connector 100 and the plug connector 200 are adapted to be mated with each other. The receptacle connector 100 includes an insulative receptacle housing 1, two rows of receptacle contacts 2 retained to the receptacle housing 1 via an insert-molding process, and a metallic shell member 3 continuously circumferentially surrounding the receptacle housing 1 via the same insert-molding process. The plug connector 200 includes an insulative plug housing 4, two rows of plug contacts 5 retained to the plug housing 4 via another insert-molding process, and a pair of metallic locking members 6 retained to two opposite ends of the plug housing 4 via the same another insert-molding process.

The receptacle housing 1 includes a base 11, a center island 12 extending upwardly form the base 11, and a circumferential wall unit 13 surrounding the center island 112 to form a loop type receiving cavity 131. Two rows of receptacle contacts are located by two sides of the center island 12. The shell member 3 is attached upon the circumferential wall unit 13. A metallic shielding/grounding member/plate 30 unitarily extends from the shell member 3.

The base 11 includes a pair of grooves 111 in an undersurface. The center island 12 forms a receiving groove 121. The circumferential wall includes a pair of side walls 132 and a pair of end walls 133. Each end of the side wall 132 includes a first abutment wall 1321 with two holes 1322 and 1323 therein. The end wall 133 forms a second abutment wall 1331.

The receptacle contact 2 includes a contacting section 21, a retaining section 23 opposite to the contacting section 21 with a U-shaped connecting section 22 therebetween, and a tail section 24.

The shell member 3 includes a pair of side plates 31 positioned upon the side walls 132, and a pair of end plates 32 positioned upon the end walls 133. The side plates 31 includes a pair of shielding sections 311 covering the first abutment walls 1321, and a first fixing leg 312 and a second fixing leg 313 opposite to each shielding section 311 in the transverse direction, a bar 314 connected between the two first fixing legs 312, and a pair of bottom arms 315 extending from two ends of the bar 314. The shielding/grounding member/plate 30 extends from the pair of bottom arms 315. The bottom arms 315 are received within the grooves 111.

The first fixing leg 312 is received within the hole 1322, and the second fixing leg 313 is received within the hole 1323. The shielding section 311 forms a protrusion 3111. The end plate 32 includes opposite inner plate 321 and the outer plate 322 respectively on opposite surfaces of the second abutment wall 1331.

The shielding/grounding member 30 extends from one side wall 31 via the corresponding bottom arm 315. Understandably, the shielding/grounding member 31 is formed by two successive bends with regard to the corresponding bar 314 via the corresponding bottom arm 315. The shielding/grounding member 30 is received within the receiving groove 121. The shielding/grounding member 30 includes a plurality of upper exposed sections 302, a lower exposed section 303 and an embedded section 304 therebetween in the vertical direction. Two opposite of the shielding/grounding member 30 extend outside of the receiving groove 121. In this embodiment, the contacts 2 are essentially between the pair of bottom arms 315 in the longitudinal direction so as not to interfere therewith.

The plug housing 4 includes a base 41 and a circumferential wall unit 42 adapted to be received within the loop type receiving cavity 131. The circumferential wall unit 42 includes a pair of long walls 421 extending along the longitudinal direction, and a pair of short walls extending along the transverse direction so as to commonly form a mating cavity 423 to receive the center island 12. Two rows of contacts 5 are disposed in the corresponding long wall 421. The pair of locking members 6 are located upon the corresponding short walls 421. Each locking member 6 includes an end part 62 and two side parts 61. The long wall 421 forms a pair of positioning grooves 4211 with a rib 4212 therebetween and a positioning hole 4213. The short wall 422 forms a pair of positioning grooves 4221 with a rib 4222 therebetween and a positioning hole 4223. The short wall 422 further includes a locking groove 4231.

The contact 5 includes a contacting section 51 for contacting the contacting section 21 of the receptacle contact 2, an abutment arm 52 for contacting the retaining section 23 of the receptacle contact 2, a connecting section 54 linked between the contacting section 21 and the abutment arm 52, and a tail 53.

The locking member 6 includes on the side part 61 two pairs of positioning arms 611 retained in the positioning grooves 4211, and therebetween a positioning post 612 which is received within the corresponding positioning hole 4213 behind the corresponding rib 4212. A recess 6111 is formed in the positioning arm 611 to receive the corresponding protrusion 3111. The end part 62 includes a pair of positioning arms 621 retained in the corresponding positioning grooves 4221, and a positioning post 622 between the pair of positioning arms 621 and retained in the positioning hole 4223. The rib 4212 is located between the pair of positioning arms 611, and the rib 422 is located between the pair of positioning arms 621. Each shielding/grounding member 6 further includes a locking arm 63 retained in the corresponding locking groove 4231.

During mating, the circumferential wall unit 42 is received within the loop type receiving cavity 131 with the center island 12 is received within the mating cavity 423. The shell member 3 is engaged between the pair of locking members 6 wherein protrusions 307 at two opposite ends of the shielding/grounding member 30 are engaged within the locking holes 631 formed in the corresponding locking arms 63. The feature of the invention is to provide in a receptacle connector 100 a metallic one-piece seamless shell member 3 with a shielding/grounding member 30 unitarily formed therewith wherein the shell member 3 circumferentially continuously surrounding the receptacle housing 1 so as to have the whole shell member 3 with the corresponding shielding/grounding member arranged with the housing stably and rigidly. In addition, because the shielding/ground member are unitary with the shell member 3, it is relatively easy to make the whole receptacle connector 100 without odd arrangements compared with the aforementioned prior arts.

What is claimed is:

1. An electrical connector assembly comprising:

a receptacle connector including:

an insulative receptacle housing having a circumferential wall unit defining with a center island therein to form a loop type receiving cavity therebetween, said center island extending along a longitudinal direction;

two rows of receptacle contacts retained, via an insert-molding process, to the circumferential wall unit and located by two sides of the center island in a transverse direction perpendicular to the longitudinal direction;

a one piece metallic shell member of a seamless structure circumferentially continuously surrounding the circumferential wall unit via said insert-molding process; and a metallic shielding/grounding member unitarily extending with the shell member and embedded within the center island via said insert-molding process; wherein two opposite ends of the shielding/grounding member are exposed to an exterior in the longitudinal direction.

2. The electrical connector assembly as claimed in claim 1, wherein the circumferential wall unit includes a pair of side walls extending along the longitudinal direction, and a pair of end walls extending in the transverse direction, and the shell member includes a pair of side plates applied upon the corresponding side walls, respectively, and the shielding/grounding member extends from one of said side plates.

3. The electrical connector assembly as claimed in claim 2, wherein each side plate includes a bar which is located upon an outer surface of the corresponding side wall, and the shielding/grounding member extends from one corresponding bar.

4. The electrical connector assembly as claimed in claim 3, wherein the shielding/grounding member is linked to the bar via a pair of bottom arms which are located around a bottom surface of the receptacle housing.

5. The electrical connector assembly as claimed in claim 4, wherein the corresponding contacts are located between the pair of bottom arms in the longitudinal direction.

6. The electrical connector assembly as claimed in claim 3, wherein each side plate further includes a shielding section applied upon an inner surface of the corresponding side wall, and at least one protrusion is formed on the shielding section.

7. The electrical connector assembly as claimed in claim 1, further including a plug connector adapted to be mated with the receptacle connector, wherein said plug connector including an insulative plug housing with a plurality of plug contacts retained in the plug housing via an insert-molding process, and a pair of metallic locking members retained to two ends of the plug housing via the same insert-molding process with the plug contacts, and the pair of locking members form two locking holes to receive corresponding protrusions at said two ends of the shielding/grounding member during mating.

8. The electrical connector assembly as claimed in claim 7, wherein the shell member includes a shielding section applied upon an inner surface of the circumferential wall unit, and at least one protrusion is formed on the shielding section which is received within a corresponding recess formed in the locking member during mating.

9. The electrical connector assembly as claimed in claim 8, wherein each locking member includes two pairs of positioning arms along the longitudinal direction, and each positioning arms forms the corresponding recess.

10. The electrical connector assembly as claimed in claim 9, wherein a rib is formed between each pair of positioning arms, and is received within a positioning hole in the plug housing.

11. An electrical connector assembly comprising:

a receptacle connector and a plug connector adapted to be mated with each other, said receptacle connector including:

an insulative receptacle housing having a circumferential wall unit defining with a center island therein to form a loop type receiving cavity therebetween, said center island extending along a longitudinal direction;

two rows of receptacle contacts retained, via an insert-molding process, to the circumferential wall unit and located by two sides of the center island in a transverse direction perpendicular to the longitudinal direction;

a one piece metallic shell member of a seamless structure circumferentially continuously surrounding the circumferential wall unit via said insert-molding process; and a metallic shielding/grounding member unitarily extending with the shell member and embedded within the center island via said insert-molding process;

said plug connector including an insulative plug housing with a plurality of plug contacts retained in the plug housing via an insert-molding process, and a pair of metallic locking members retained to two ends of the plug housing via the same insert-molding process with the plug contacts, wherein the shielding/grounding member is mechanically and electrically connected with the pair of locking members during mating.

12. The electrical connector assembly as claimed in claim 11, wherein two opposite ends of the shielding/grounding member are exposed to an exterior in the longitudinal direction.

13. The electrical connector assembly as claimed in claim 12, wherein a pair of protrusions are formed at said two opposite ends of the shielding/grounding member, and the pair of locking members form corresponding locking holes receiving said protrusions.

14. The electrical connector assembly as claimed in claim 11, wherein the circumferential wall unit includes a pair of side walls extending along the longitudinal direction, and a pair of end walls extending in the transverse direction, and the shell member includes a pair of side plates applied upon the corresponding side walls, respectively, and the shielding/grounding member extends from one of said side plates.

15. The electrical connector assembly as claimed in claim 12, wherein each side plate includes a bar which is located upon an outer surface of the corresponding side wall, and the shielding/grounding member extends from one corresponding bar.

16. The electrical connector assembly as claimed in claim 13, wherein the shielding/grounding member is linked to the bar via a pair of bottom arms which are located around a bottom surface of the receptacle housing.

17. The electrical connector assembly as claimed in claim 14, wherein the corresponding contacts are located between the pair of bottom arms in the longitudinal direction.

18. The electrical connector assembly as claimed in claim 13, wherein each side plate further includes a shielding section applied upon an inner surface of the corresponding side wall, and at least one protrusion is formed on the shielding section.

19. A receptacle connector for mating with a plug connector having pair of metallic locking members at two opposite ends along a longitudinal direction, comprising:

an insulative receptacle housing having a circumferential wall unit defining with a center island therein to form a loop type receiving cavity therebetween, said center island extending along a longitudinal direction;

two rows of receptacle contacts retained, via an insert-molding process, to the circumferential wall unit and located by two sides of the center island in a transverse direction perpendicular to the longitudinal direction;

a one piece metallic shell member of a seamless structure circumferentially continuously surrounding the circumferential wall unit via said insert-molding process; and a metallic shielding/grounding member unitarily extending with the shell member and embedded within the center island via said insert-molding process; wherein said circumferential wall unit includes a pair of side walls and a pair of end wall, and the shell member includes a pair of side plates applied upon the corresponding side walls, and a pair of end walls applied upon the corresponding end walls, and the shielding/grounding member extend from one corresponding side plate.

20. The receptacle connector as claimed in claim 19, wherein said shielding/grounding member is unitarily linked to the corresponding side plate via a pair of bottom arms, and the corresponding contacts by the corresponding side of the center island are located between the pair of bottom arms in the longitudinal direction.

* * * * *